US005489033A

United States Patent [19]

Luebke

[11] Patent Number: 5,489,033

[45] Date of Patent: Feb. 6, 1996

[54] LOW HEADROOM STACKER CRANE

[75] Inventor: Roger D. Luebke, Hartford, Wis.

[73] Assignee: Harnischfeger Corporation, Brookfield, Wis.

[21] Appl. No.: 163,936

[22] Filed: Dec. 8, 1993

[51] Int. Cl.[6] ..... B66C 11/08

[52] U.S. Cl. ..... 212/318; 212/319; 212/333

[58] Field of Search ..... 212/128, 129, 212/130, 212, 318, 319, 333; 414/283

[56] References Cited

U.S. PATENT DOCUMENTS

| | | | |
|---|---|---|---|
| 660,477 | 10/1900 | Wellman et al. | 212/129 |
| 729,251 | 5/1903 | Aiken | 212/129 |
| 1,098,090 | 5/1914 | Brower | 212/128 |
| 1,674,967 | 6/1928 | Fitch | 212/212 |
| 2,553,378 | 5/1951 | Miller | 212/128 |
| 2,947,426 | 8/1960 | Cotesworth et al. | 212/128 |
| 2,964,459 | 12/1960 | Pearson | 212/129 |
| 3,104,016 | 9/1963 | Harry | 212/129 |
| 3,422,963 | 1/1969 | Dehn | 212/128 |
| 3,550,788 | 12/1970 | Auzins | 212/212 |
| 3,557,974 | 1/1971 | Ostrander | 414/283 |
| 3,768,668 | 10/1973 | Schukei | 212/129 |
| 3,771,666 | 11/1973 | Fournier | 212/212 |
| 3,848,703 | 11/1974 | Rundle | 212/128 |
| 4,375,936 | 3/1983 | Dechantsreiter | 414/626 |

*Primary Examiner*—Margaret A. Focarino
*Assistant Examiner*—Thomas J. Brahan
*Attorney, Agent, or Firm*—Michael, Best & Friedrich

[57] ABSTRACT

A stacker crane comprising a trolley moveable above the ground, the trolley including a frame, a turntable supported by the frame for rotation relative to the frame about a generally vertical rotation axis, and a rotate drive which rotates the turntable relative to the frame, a mast assembly depending from and fixedly mounted to the turntable so that the mast assembly rotates with the turntable relative to the trolley frame, a carriage supported by the mast assembly for vertical movement relative thereto and for common rotation therewith relative to the trolley frame, a load engaging mechanism mounted on the carriage, and a hoist assembly including a hoist drum which has an axis of rotation fixed relative to the trolley frame and which is rotatable in one direction and in an opposite direction, and a hoist rope wound around the drum and connected to the carriage such that rotation of the drum in the one direction raises the carriage and rotation of the drum in the opposite direction lowers the carriage.

20 Claims, 5 Drawing Sheets

LOW HEADROOM STACKER CRANE

BACKGROUND OF THE INVENTION

The invention relates to stacker cranes. A conventional stacker crane has a bridge moving along a runway, and a trolley moving along the bridge. A typical trolley runs on top of the bridge, i.e., the entire trolley is located above the top of the bridge. The trolley includes a frame and a turntable rotatable relative to the frame about a vertical axis. The turntable is supported by a rotate bearing on top of the trolley frame. A rotate drive fixed relative to the turntable rotates the turntable relative to the trolley frame.

The conventional stacker crane also includes a mast assembly depending from and fixed to the turntable. The mast assembly includes an upper or rigid mast depending from the turntable, and an intermediate mast moveable vertically along the rigid mast. A carriage is moveable vertically relative to the intermediate mast, and a load engaging mechanism, such as forks or jaws, move with the carriage.

The carriage is raised and lowered by a hoist assembly. The hoist assembly includes a drum which is mounted on the turntable and which moves with the turntable relative to the trolley frame, a drum drive which is mounted on the turntable and which moves with the turntable relative to the trolley frame, a bottom block fixed to the carriage, and a rope or cable wound around the drum and reeved around the bottom block. Rotation of the drum in one direction raises the carriage, and rotation of the drum in the other direction lowers the carriage. When the rotate drive is actuated, the turntable, the mast assembly, the carriage, the load engaging mechanism and the hoist all rotate relative to the trolley frame.

SUMMARY OF THE INVENTION

The invention provides a stacker crane particularly suited for use on a relatively narrow bridge with low headroom. The stacker crane of the invention has a hoist that is fixed or stationary relative to the trolley frame, with the rotate bearing on the underside of the trolley frame. To accommodate the stationary hoist, an inverted bottom block rotates relative to the carriage. The mast is offset from the center of rotation to provide clearance for the hoist rope. The offset mast moves the load closer to the center of rotation. This reduces moment loading and structural support, thereby reducing bridge wheel loads. Because the hoist is stationary on the trolley, the hoist motor can be wired directly. The rotate conductors are only small control wires. A variable frequency AC control can be employed. Such a control could have sliding contact and continuous rotation, without danger to the inverter.

More particularly, the invention provides a low headroom stacker crane comprising a bridge moveable along a runway, and a trolley moveable along the bridge. The trolley includes a frame having opposite outer portions that move along the spaced bridge members, and a recessed inner portion that extends downwardly between the spaced bridge members. A turntable and a rotate bearing therefor are mounted on the underside of the trolley frame inner portion. A rotate drive, which rotates the turntable about a vertical axis relative to the trolley frame, is fixedly mounted on the inner portion of the trolley frame. Also fixedly mounted on the inner portion of the trolley frame are a hoist drive and a hoist drum.

The stacker crane also comprises a rigid mast fixed to and depending from the turntable, an intermediate mast moveable vertically along the rigid mast, and a carriage moveable vertically along the intermediate mast. The rigid mast, the intermediate mast and the carriage rotate with the turntable relative to the trolley frame. The carriage has thereon a load engaging mechanism, such as forks. An inverted bottom block is fixed against vertical movement relative to the carriage while being rotatable relative to the carriage about the center of rotation of the mast assembly. A hoist rope or cable is wound around the hoist drum and reeved around the bottom block such that rotation of the drum in one direction raises the carriage and rotation of the drum in the other direction lowers the carriage. The hoist rope extends through an opening in the turntable, and the turntable, the mast assembly, the carriage and the load engaging mechanism rotate relative to the hoist rope and the bottom block (as well as the hoist drum and the hoist drive) when the rotate drive is actuated.

Other features and advantages of the invention will become apparent to those skilled in the art upon review of the following detailed description, claims and drawings.

Figure 1:
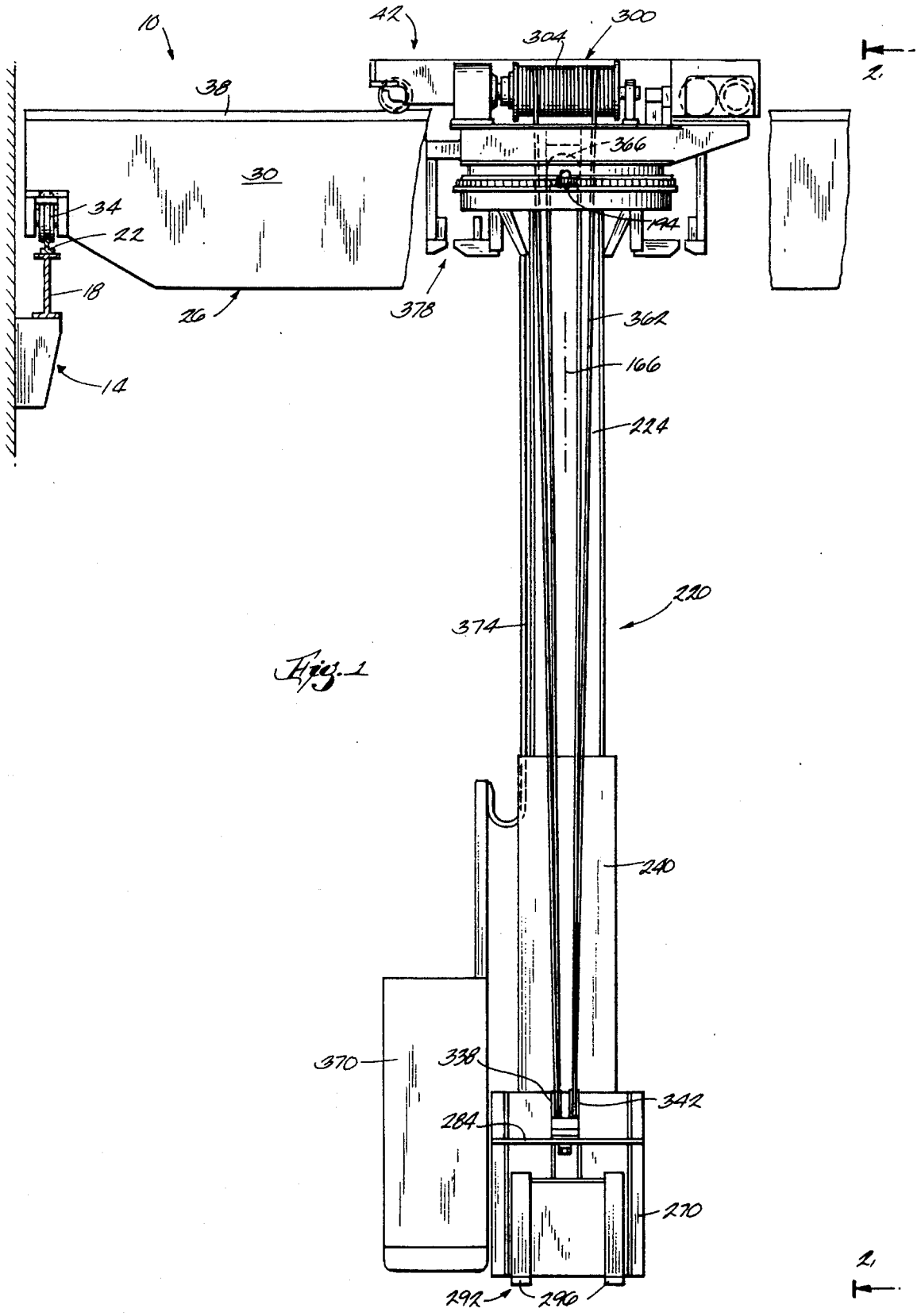
FIG. 1 is an elevational view, partially broken away and in section, of a stacker crane embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A stacker crane 10 embodying the invention is illustrated in the drawings. The stacker crane 10 comprises (see FIG. 1) a runway 14 supported above the floor of a building. The runway 14 includes spaced horizontal beams 18 (only one is shown) supported by opposite walls of the building. Each beam 18 has thereon a rail 22 (one shown in FIG. 1). The crane 10 also comprises a bridge 26 moveable along the runway 14. The bridge 26 includes (see FIGS. 1, 2 and 4) parallel, spaced apart, horizontal bridge members 30 and 32 extending between the runway beams 18. One end of each bridge member is supported by wheels 34 (see FIGS. 1 and 2) for movement along the rail 22 on one beam 18, and the opposite end of each bridge member is supported by wheels (not shown) for movement along the rail 22 on the other beam 18. The bridge members 30 and 32 have thereon (see FIG. 2) respective horizontal rails 38 and 40. The rails 38 and 40 are parallel and extend perpendicular to the runway rails 22. A bridge drive (not shown) moves the bridge 26 along the runway 14. The stacker crane 10 as thus far described is conventional and will not be described in greater detail.

Figure 6:
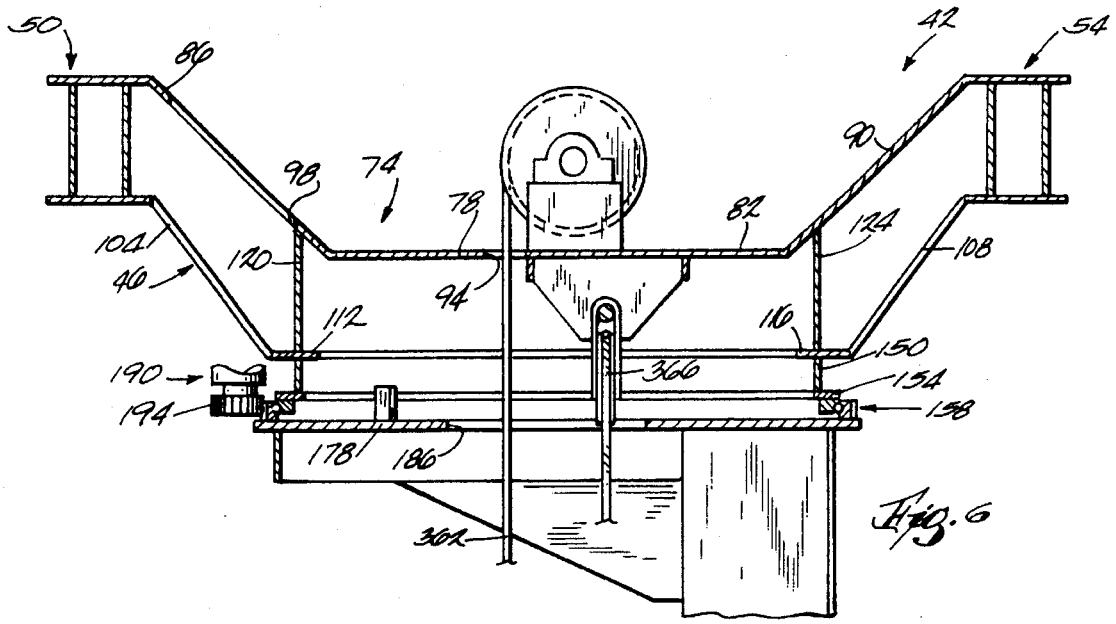
FIG. 6 is a view taken generally along line 6—6 in FIG. 4.

The stacker crane 10 also comprises (see FIGS. 1–4 and 6) a trolley 42 moveable along the bridge rails 38 and 40. The trolley 42 includes (see FIG. 4) a frame 46 having spaced outer portions or wheel assemblies 50 and 54 respectively moveable along the rails 38 and 40. The wheel assembly 50 includes wheels 58 and 62 which are spaced in the direction of the rail 38 and which roll along the rail 38, and the wheel assembly 54 includes wheels 66 and 70 which are spaced in the direction of the rail 40 and which roll along the rail 40. The frame 46 also has (see FIGS. 4 and 6) a recessed inner portion 74 connecting the wheel assemblies 50 and 54 and extending downwardly between the bridge members 30 and 32. The frame inner portion 74 includes a top plate 78 having a planar, horizontal center portion 82, a planar side portion 86 extending upwardly and outwardly from the left side of the center portion 82 (as seen in FIG. 6) to the wheel assembly 50, and a planar side portion 90 extending upwardly and outwardly from the right side of the center portion 82 (as seen in FIG. 6) to the wheel assembly 54. The center portion 82 has therein a generally centrally located elongated opening 94, and the left side portion 86 has therein a circular or elliptical opening 98. The inner portion 74 of the frame 46 also includes (see FIG. 6) supporting members 104, 108, 112, 116, 120 and 124 below the top plate 78. An annular member 150 extends downwardly from the supporting members 112 and 116, and a horizontally extending, annular plate 154 is welded to the bottom of the annular member 150. A conventional rotate bearing 158 is secured to the underside of the plate 154. The rotate bearing 158 includes (see FIG. 7) an annular inner race 162 which is centered on a vertical axis 166 (see FIG. 1) and which is fixedly mounted on the underside of the plate 154 by suitable means such as bolts 166, an annular outer race 170 surrounding the inner race 162, and bearings 172 captured between the inner and outer races such that the outer race 170 is rotatable about the axis 166. The outside of the outer race 170 has thereon teeth 174.

Figure 4:
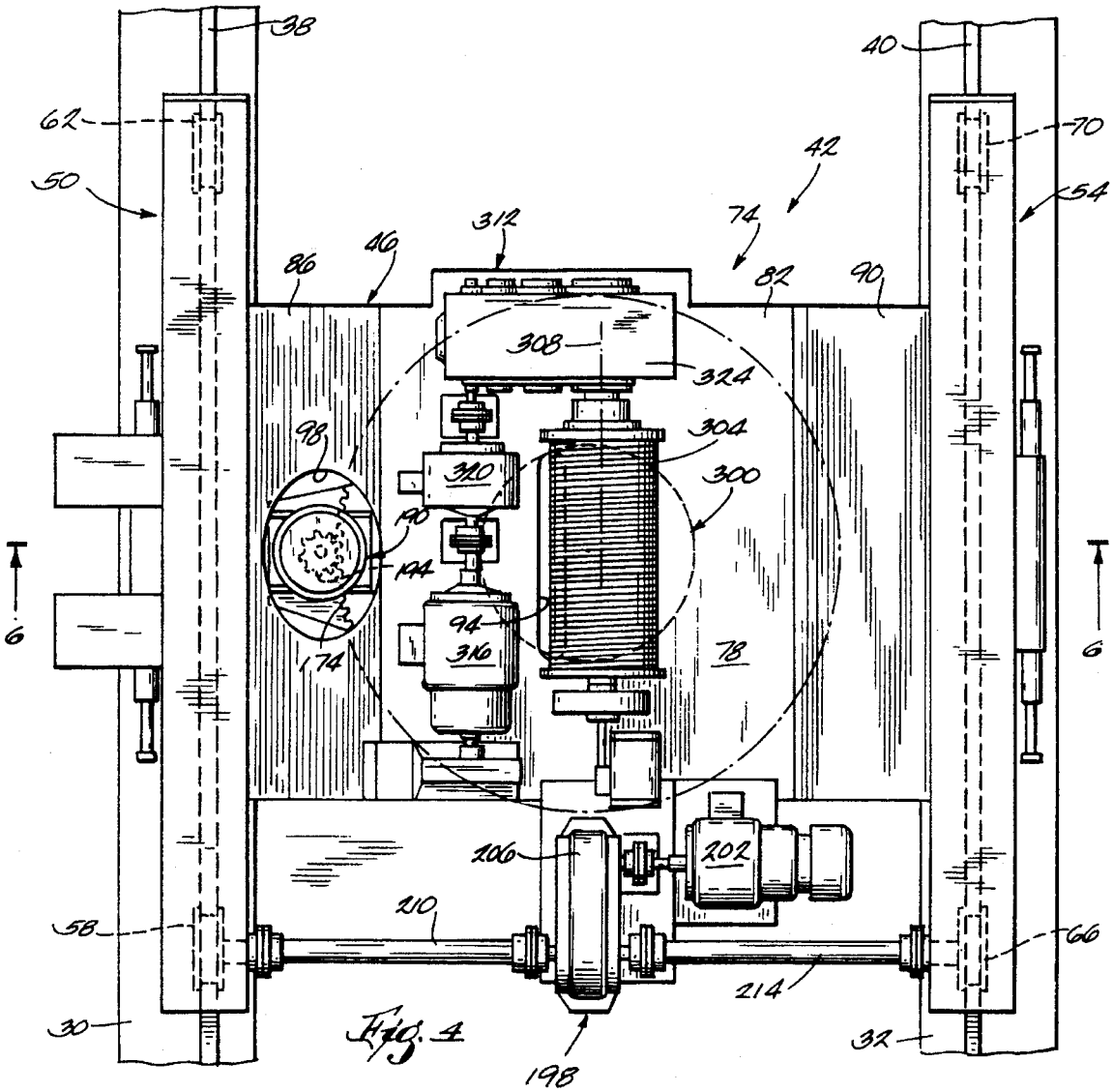
FIG. 4 is a view taken along line 4—4 in FIG. 2.
Figure 7:
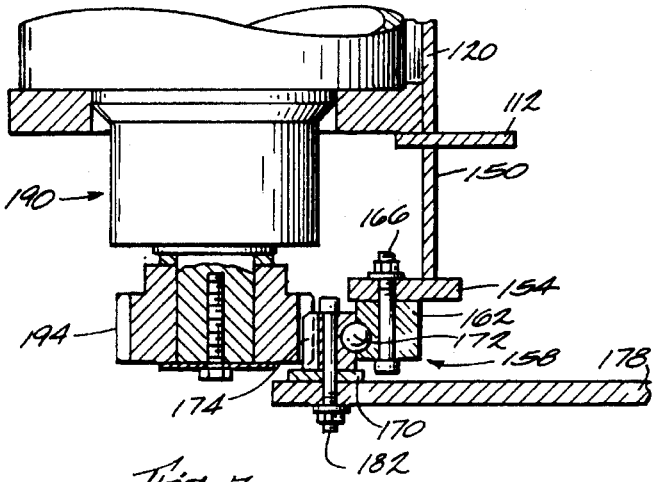
FIG. 7 is an enlarged portion of FIG. 6.

The trolley 42 also includes (see FIGS. 6 and 7) a turntable 178 supported by the rotate bearing 158 for rotation relative to the frame 46 about the axis 166. More particularly, the turntable 178 is a horizontally extending, circular plate fixedly mounted to the underside of the outer race 170 by suitable means such as bolts 182 (see FIG. 7). The turntable 178 has therein (see FIG. 6) a circular aperture 186 centered on the axis 166. As shown in FIGS. 4, 6 and 7, a conventional rotate drive 190 is fixedly mounted on the inner portion 74 of the frame 46. The rotate drive 190 extends through the opening 98 in the top plate 78, and the lower end of the rotate drive 190 has a downwardly extending output shaft having thereon a pinion 194 meshing with the teeth 174 on the outer race 170, such that rotation of the pinion 194 causes rotation of the outer race 170 and the turntable 178 about the axis 166.

The trolley 42 further includes (see FIG. 4) a conventional traverse drive 198 fixedly mounted on the frame inner portion 74. The traverse drive 198 includes a motor 202, a reducer 206, and drive shafts 210 and 214 extending from the reducer 206 to the wheels 58 and 66, respectively.

Figure 5:
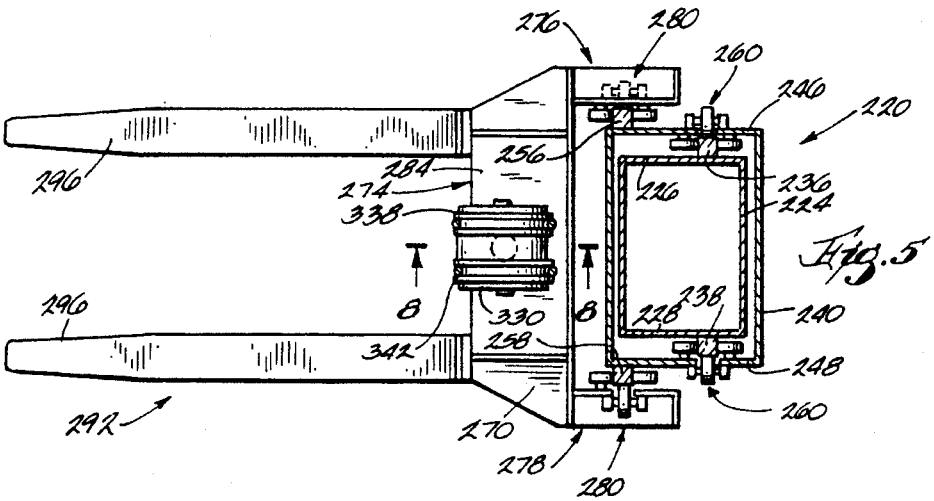
FIG. 5 is a view taken along line 5—5 in FIG. 2.

The stacker crane 10 also comprises (see FIGS. 1, 2 and 5) a mast assembly 220. The mast assembly 220 includes a rigid mast 224 depending from and fixedly mounted to the underside of the turntable 178 so that the rigid mast 224 rotates with the turntable 178, relative to the frame 46, about the axis 166. As best shown in FIG. 5, the rigid mast 224 has a box-like construction and includes opposed side walls 226 and 228 having thereon respective vertically extending rails 236 and 238. The mast assembly 220 also includes an intermediate mast 240 supported by the rigid mast 224 for vertical movement relative thereto. As best shown in FIG. 5, the intermediate mast 240 has a box-like construction and telescopes over the rigid mast 224. The intermediate mast 240 has opposed side walls 246 and 248 respectively spaced from the rigid mast side walls 226 and 228. The side walls 246 and 248 have thereon respective vertically extending rails 256 and 258. Each intermediate mast side wall 246 or 248 has thereon upper and lower roller assemblies 260 engaging the associated rail 236 or 238. Such roller assemblies 260 are conventional and will not be described in greater detail. The roller assemblies 260 restrict the intermediate mast 240 to telescoping vertical movement along the rigid mast 224. The intermediate mast 240 is moveable relative to the rigid mast 224 between a lower position shown in FIG. 2 and a raised position shown in FIG. 3.

Figure 8:
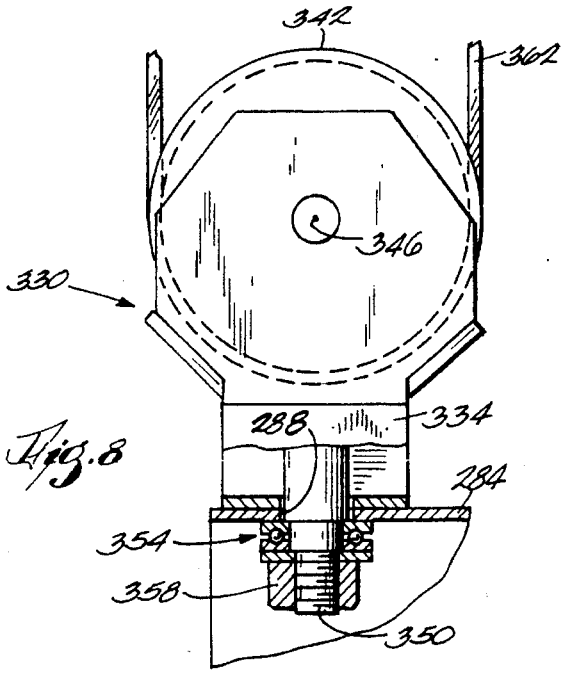
FIG. 8 is a view taken along line 8—8 in FIG. 5.

The stacker crane 10 also comprises (see FIGS. 1, 2 and 5) a carriage 270 supported by the intermediate mast 240 for vertical movement relative thereto and for common rotation therewith relative to the trolley frame 46. As best shown in FIG. 5, the carriage 270 is generally U-shaped when viewed from above and includes a front or main portion 274 located in front of the intermediate mast 240 (to the left in FIG. 5), and spaced side portions 276 and 278 extending outside of the intermediate mast side walls 246 and 248, respectively. Each of the side portions 276 and 278 has upper and lower roller assemblies 280. The roller assemblies 280 on the side portion 276 engage the rail 256, and the roller assemblies 280 on the side portion 278 engage the rail 258. The roller assemblies 280 are substantially identical to the roller assemblies 260 and restrict the carriage 270 to vertical movement along the intermediate mast 240. As shown in FIGS. 1, 5 and 8, the main portion 274 of the carriage 270 includes a horizontally extending plate 284 having therein an aperture 288 centered on the axis 166.

The stacker crane 10 further comprises (see FIGS. 1 and 2) a load engaging mechanism 292 mounted on the carriage 270. In the illustrated construction, the load engaging mechanism 292 is a pair of conventional forks 296. Other types of load engaging mechanisms, such as jaws, a magnet or a single rod, can be employed.

Figure 2:
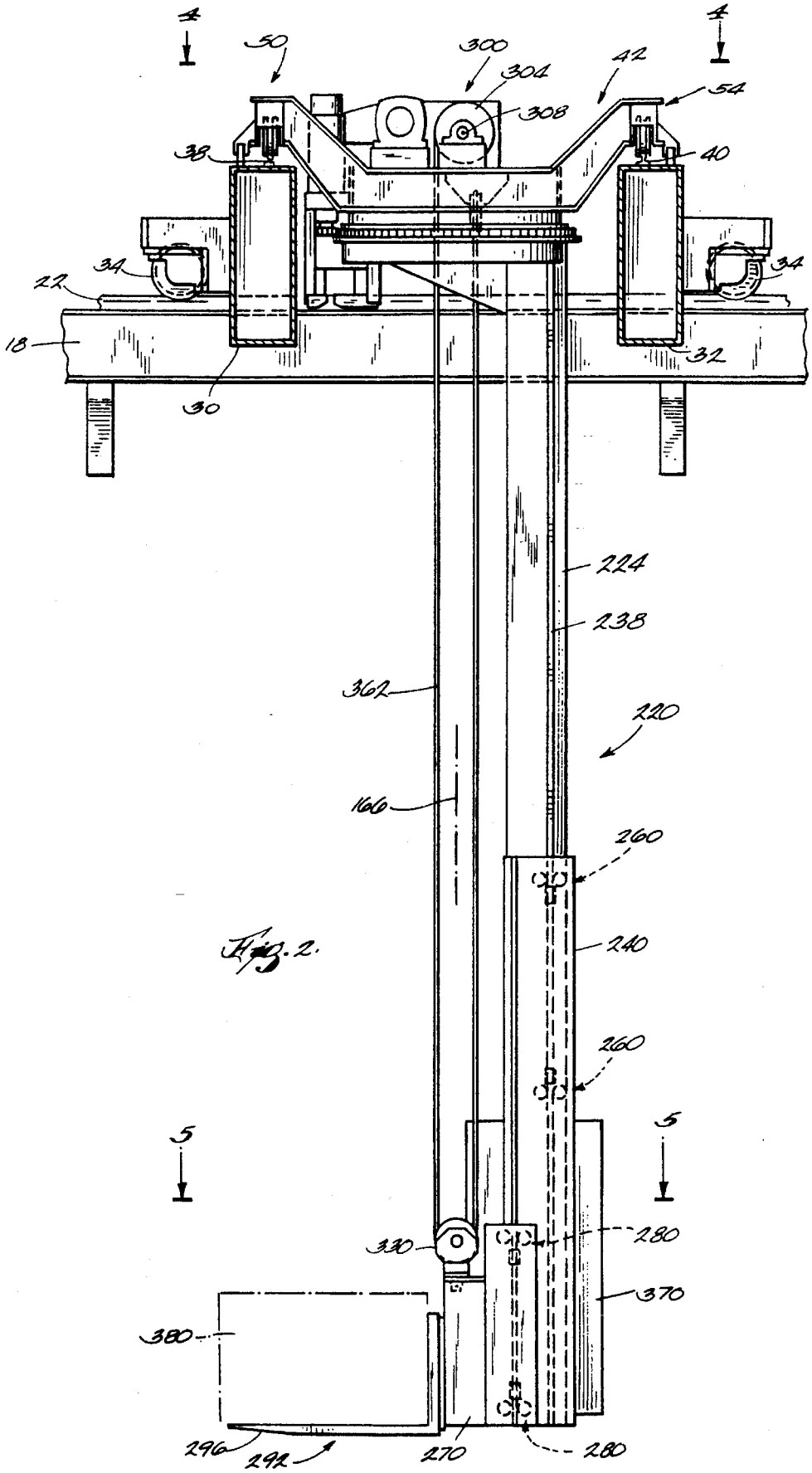
FIG. 2 is a view taken along line 2—2 in FIG. 1.

The stacker crane 10 further comprises (see FIGS. 2 and 4) a hoist assembly 300. The hoist assembly 300 includes a hoist drum 304 fixedly mounted on top of the top plate 78 of the trolley frame 46. The drum 304 has a horizontal axis of rotation 308 which is fixed relative to the trolley frame 46, and the drum 304 is rotatable in opposite directions about the axis 308. The hoist assembly 300 also includes a drum drive 312 fixedly mounted on the top plate 78. The drum drive 312 includes a brake 316, a motor 320, and a reducer 324. Such a hoist drum and drive arrangement is conventional and will not be described in greater detail. The hoist assembly 300 also includes (see FIGS. 1, 5 and 8) an inverted bottom block 330 connected to the carriage 270 for common vertical movement therewith and for rotation of the carriage 270 relative to the bottom block 330 about the axis 166. More particularly, the bottom block 330 includes (see FIG. 8) a frame 334 supporting a pair of sheaves 338 and 342 for rotation about a horizontal axis 346. A stud 350 extends downwardly from the frame 334 and is centered on the axis 166. The stud 350 extends through the aperture 288 in the carriage plate 284 and has a threaded lower end. A thrust bearing 354 surrounds the stud 350 beneath the plate 284, and a nut 358 is threaded onto the lower end of the stud 350 such that the thrust bearing 354 is captured between the nut 358 and the plate 284. Thus, the weight of the carriage 270 is supported by the bottom block 330 through the thrust bearing 354, the nut 358 and the stud 350. A hoist rope 362 is wound around the drum 304 and is reeved around the bottom block sheaves 338 and 342 and an equalizer sheave 366 (FIGS. 1 and 6) suspended from the top plate 78. More particularly, the rope 362 extends, as seen in FIG. 1, downwardly from the left side of the drum 304 around the left sheave 338, upwardly over the equalizer sheave 366, downwardly around the right sheave 342,.and upwardly to the right side of the drum 304. As shown in FIG. 6, the rope runs wound around the drum 304 extend through the opening 94 in the top plate 78, and all rope runs extend through the opening 186 in the turntable 178. As is apparent from FIGS. 1 and 2, clockwise rotation of the drum 304 as seen in FIG. 2 raises the carriage 270, and counterclockwise rotation of the drum 304 lowers the carriage 270. The pivotal connection of the bottom block 330 to the carriage 270 permits the carriage 270, the mast assembly 220 and the turntable 178 to rotate relative to the hoist rope 362 and the bottom block 330.

The stacker crane 10 also comprises (see FIG. 1) an operator's cab 370 fixedly mounted on the left of the carriage 270 as seen in FIG. 1. The operator's cab 370 is conventional and will not be described in greater detail. As is known in the art, control wires extend from the cab 370 to the trolley frame 46 via vertical conductors 374 and rotate conductors 378.

Figure 3:
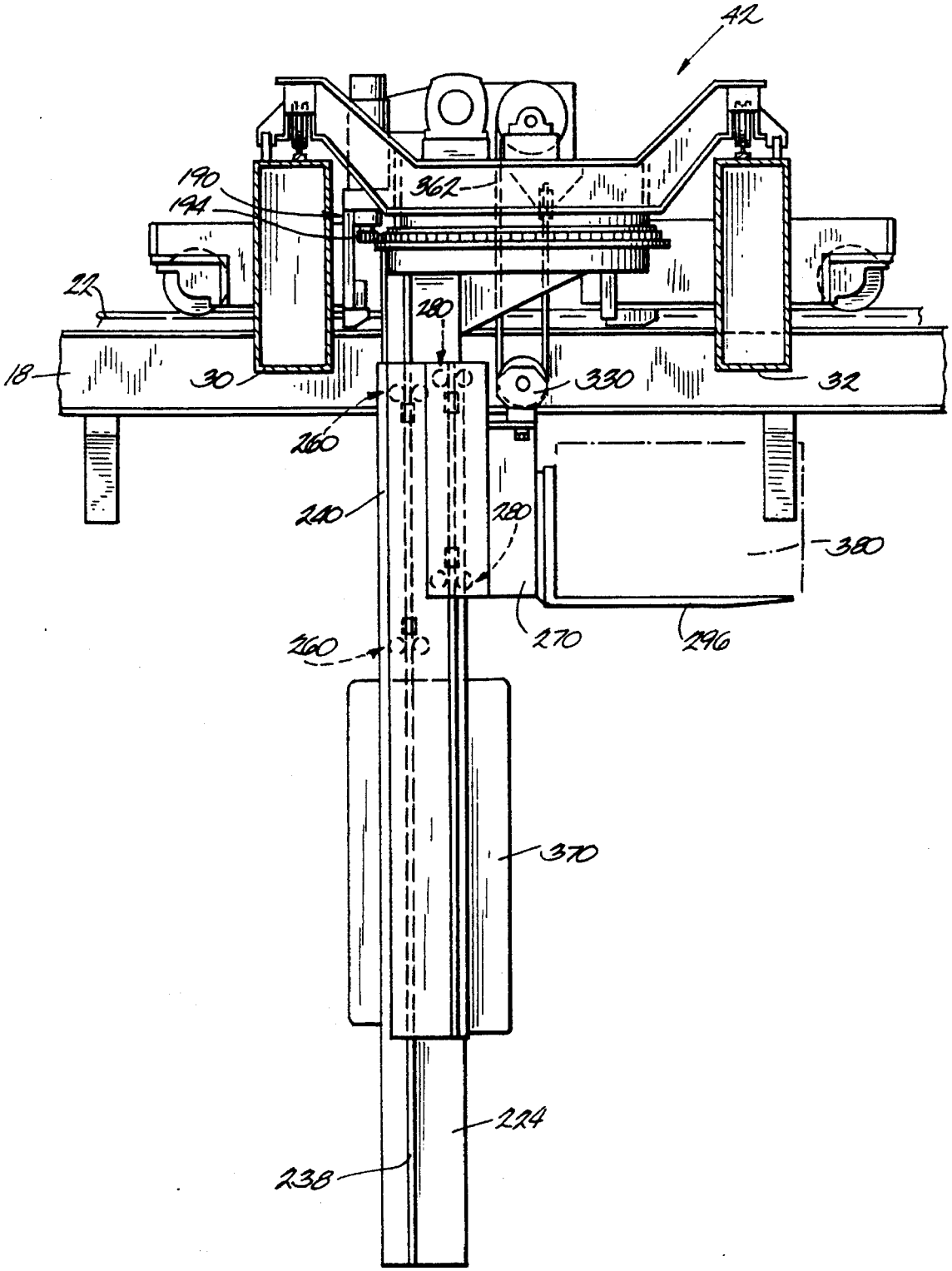
FIG. 3 is a view similar to FIG. 2 showing the mast assembly rotated 180° and the carriage completely raised.

FIGS. 2 and 3 illustrate a load 380 (shown in phantom) being raised and rotated by the stacker crane 10. The carriage 270 is in its lower position and the load 380 is facing to the left in FIG. 2. The carriage 270 is in its raised position and the load 380 is facing to the right in FIG. 3. The bottom block 330 moves upwardly to move the carriage 270 from its lower position to its raised position, but the hoist rope 362 and the bottom block 330 do not rotate as the load 380 is rotated from the left to the right. Instead, the turntable 178, the mast assembly 220, the carriage 270, the load engaging mechanism 292 and the load 380 rotate (due to actuation to the rotate drive 190) relative to the trolley frame 46, the hoist drum 304, the rope 362 and the bottom block 330.

Various features of the invention are set forth in the following claims.

I claim:

1. A stacker crane comprising a trolley moveable above the ground, said trolley including a frame, said frame having opposite outer portions and a recessed inner portion extending downwardly between said outer portions, a turntable supported by said frame for rotation relative to said frame about a generally vertical rotation axis, said turntable being supported beneath said frame inner portion, and a rotate drive which rotates said turntable relative to said frame, a mast assembly including an elongated rigid mast depending from and fixedly mounted to said turntable so that said rigid mast rotates with said turntable relative to said trolley frame and so that said rigid mast is fixed against vertical movement relative to said trolley frame, a carriage supported by said rigid mast for vertical movement along said mast and for common rotation with said mast relative to said trolley frame, a load engaging mechanism mounted on said carriage, and a hoist assembly including a hoist drum which has an axis of rotation fixed relative to said trolley frame and which is rotatable about said axis of rotation in one direction and in an opposite direction, and a hoist rope wound around said drum and connected to said carriage such that rotation of said drum about said axis of rotation in said one direction raises said carriage and rotation of said drum about said axis of rotation in said opposite direction lowers said carriage, whereby actuation of said rotate drive causes said turntable, said mast assembly, said carriage and said load engaging mechanism to rotate relative to said trolley frame, said hoist drum and said hoist rope.

2. A stacker crane as set forth in claim 1 wherein said hoist drum is mounted on said frame inner portion.

3. A stacker crane as set forth in claim 2 wherein said hoist assembly also includes a drum drive fixedly mounted on said frame inner portion and drivingly connected to said drum.

4. A stacker crane as set forth in claim 1 wherein said hoist assembly also includes a bottom block connected to said carriage for common vertical movement therewith and for rotation of said carriage relative to said bottom block about said rotation axis, and wherein said hoist rope is reeved around said bottom block.

5. A stacker crane as set forth in claim 1 wherein said rotate drive is fixedly mounted on said frame inner portion.

6. A stacker crane as set forth in claim 1 wherein said mast assembly also includes an intermediate mast supported by said rigid mast for vertical movement along said rigid mast, and wherein said carriage is supported by said intermediate mast.

7. A crane as set forth in claim 1 wherein said frame inner portion has an underside, wherein said frame also includes a horizontally extending, annular plate which is secured to said underside of said frame inner portion and which has an underside, and a rotate bearing which is secured to said underside of said annular plate and which has an underside, and wherein said turntable is secured to said underside of said rotate bearing.

8. A crane as set forth in claim 7 wherein said frame inner portion includes a top plate having an underside and having a planar, horizontal center portion having opposite sides, a planar side portion extending upwardly and outwardly from one side of said center portion to one of said frame outer portions, and a planar side portion extending upwardly and outwardly from the opposite side of said center portion to the other of said frame outer portions, and wherein said annular plate is secured to said underside of said top plate.

9. A crane as set forth in claim 1 wherein said hoist rope extends substantially along said rotation axis, and wherein said mast is offset from and not centered on said rotation axis.

10. A stacker crane as set forth in claim 1 wherein said mast has thereon a vertically extending rail, and wherein said carriage is supported for movement along said mast by rollers engaging said rail.

11. A stacker crane comprising a bridge which has a longitudinal axis and which is supported above the ground for movement along a runway and in a direction generally perpendicular to said axis, said bridge including spaced bridge members extending generally parallel to said axis, a trolley moveable along said bridge in the direction of said axis, said trolley including a frame having opposite outer portions each moveable along a respective one of said bridge members, and a recessed inner portion extending downwardly between said bridge members, a traverse drive which is fixedly mounted on said frame and which drives said frame along said bridge, a turntable supported beneath said frame inner portion for rotation relative to said frame about a generally vertical rotation axis, and a rotate drive which is fixedly mounted on said frame and which rotates said turntable relative to said frame, a mast assembly including an elongated rigid mast depending from and fixedly mounted to said turntable so that said rigid mast rotates with said turntable relative to said trolley frame and so that said rigid mast is fixed against vertical movement relative to said trolley frame, a carriage supported by said rigid mast for vertical movement along said mast and for common rotation with said mast relative to said trolley frame, a load engaging mechanism mounted on said carriage, and a hoist assembly including a hoist drum which is fixedly mounted on said frame inner portion, which has an axis of rotation fixed relative to said trolley frame, and which is rotatable about said axis of rotation in one direction and in an opposite direction, a drum drive fixedly mounted on said trolley frame and drivingly connected to said drum, a bottom block connected to said carriage for common vertical movement therewith and for rotation of said carriage relative to said bottom block about said rotation axis, and a hoist rope wound around said drum and reeved around said bottom block such that rotation of said drum about said axis of rotation in said one direction raises said carriage and rotation of said drum about said axis of rotation in said opposite direction lowers said carriage, whereby actuation of said rotate drive causes said turntable, said mast assembly, said carriage and said load engaging mechanism to rotate relative to said trolley frame, said hoist drum, said bottom block and said hoist rope.

12. A crane as set forth in claim 11 wherein said frame inner portion has an underside, wherein said frame also includes a horizontally extending, annular plate which is secured to said underside of said frame inner portion and which has an underside, and a rotate bearing which is secured to said underside of said annular plate and which has an underside, and wherein said turntable is secured to said underside of said rotate bearing.

13. A crane as set forth in claim 12 wherein said frame inner portion includes a top plate having an underside and having a planar, horizontal center portion having opposite sides, a planar side portion extending upwardly and outwardly from one side of said center portion to one of said frame outer portions, and a planar side portion extending upwardly and outwardly from the opposite side of said center portion to the other of said frame outer portions, and wherein said annular plate is secured to said underside of said top plate.

14. A crane as set forth in claim 11 wherein said hoist rope extends substantially along said rotation axis, and wherein said mast is offset from and not centered on said rotation axis.

15. A stacker crane as set forth in claim 11 wherein said mast has thereon a vertically extending rail, and wherein said carriage is supported for movement along said mast by rollers engaging said rail.

16. A stacker crane comprising a trolley moveable above the ground, said trolley including a frame, said frame having opposite outer portions and a recessed inner portion extending downwardly between said outer portions, a turntable supported by said frame beneath said frame inner portion for rotation relative to said frame about a generally vertical rotation axis, and a rotate drive which is fixedly mounted on said frame and which rotates said turntable relative to said frame, a mast assembly including an elongated rigid mast depending from and fixedly mounted to said turntable so that said rigid mast rotates with said turntable relative to said trolley frame and so that said rigid mast is fixed against vertical movement relative to said trolley frame, and an intermediate mast supported by said rigid mast for vertical movement along said rigid mast, a carriage supported by said intermediate mast for vertical movement relative thereto and for common rotation with said rigid and intermediate masts relative to said trolley frame, a load engaging mechanism mounted on said carriage, and a hoist assembly including a hoist drum which is mounted on said frame inner portion, which has an axis of rotation fixed relative to said trolley frame and which is rotatable about said axis of rotation in one direction and in an opposite direction, a bottom block connected to said carriage for common vertical movement therewith and for rotation of said carriage relative to said bottom block about said rotation axis, a hoist rope wound around said drum and reeved around said bottom block such that rotation of said drum about said axis of rotation in said one direction raises said carriage and rotation of said drum about said axis of rotation in said opposite direction lowers said carriage, and a drum drive fixedly mounted on said frame inner portion and drivingly connected to said drum, whereby actuation of said rotate drive causes said turntable, said mast assembly, said carriage and said load engaging mechanism to rotate relative to said trolley frame, said hoist drum and said hoist rope.

17. A crane as set forth in claim 16 wherein said frame inner portion has an underside, wherein said frame also includes a horizontally extending, annular plate which is secured to said underside of said frame inner portion and which has an underside, and a rotate bearing which is secured to said underside of said annular plate and which has an underside, and wherein said turntable is secured to said underside of said rotate bearing.

18. A crane as set forth in claim 17 wherein said frame inner portion includes a top plate having an underside and having a planar, horizontal center portion having opposite sides, a planar side portion extending upwardly and outwardly from one side of said center portion to one of said frame outer portions, and a planar side portion extending upwardly and outwardly from the opposite side of said center portion to the other of said frame outer portions, and wherein said annular plate is secured to said underside of said top plate.

19. A crane as set forth in claim 16 wherein said hoist rope extends substantially along said rotation axis, and wherein said mast is offset from and not centered on said rotation axis.

20. A stacker crane as set forth in claim 16 wherein said rigid mast has thereon a vertically extending rigid mast rail, wherein said intermediate mast is supported for movement along said rigid mast by rollers engaging said rigid mast rail, wherein said intermediate mast has thereon a vertically extending intermediate mast rail, and wherein said carriage is supported for movement along said intermediate mast by rollers engaging said intermediate mast rail.

* * * * *